US008459705B2

(12) United States Patent
Suh et al.

(10) Patent No.: US 8,459,705 B2
(45) Date of Patent: Jun. 11, 2013

(54) DOOR LOCK APPARATUS

(75) Inventors: Sang-Won Suh, Seoul (KR); Cheong-Won Choi, Jeongeup-si (KR)

(73) Assignee: Dual Mechanics Co., Ltd., Jeongeup-si (KR)

( * ) Notice: Subject to any disclaimer, the term of this patent is extended or adjusted under 35 U.S.C. 154(b) by 460 days.

(21) Appl. No.: 12/786,675

(22) Filed: May 25, 2010

(65) Prior Publication Data

US 2011/0203332 A1 Aug. 25, 2011

(30) Foreign Application Priority Data

Feb. 25, 2010 (KR) ..... 10-2010-0017205

(51) Int. Cl.

| | |
|---|---|
| ***E05C 3/06*** | (2006.01) |
| *E05C 1/06* | (2006.01) |
| *E05C 5/00* | (2006.01) |
| *E05C 9/12* | (2006.01) |

(52) U.S. Cl.
USPC ..... 292/201; 292/140; 292/56; 292/63; 292/DIG. 69; 292/DIG. 71

(58) Field of Classification Search
USPC ..... 292/140, DIG. 69, DIG. 71
See application file for complete search history.

(56) References Cited

U.S. PATENT DOCUMENTS

| | | | | |
|---|---|---|---|---|
| 4,321,445 | A * | 3/1982 | Kristof et al. | 219/724 |
| 4,516,007 | A * | 5/1985 | Ringdahl et al. | 219/722 |
| 4,755,647 | A * | 7/1988 | Nishikawa et al. | 219/724 |

(Continued)

FOREIGN PATENT DOCUMENTS

| | | |
|---|---|---|
| EP | 1304436 A2 | 4/2003 |
| EP | 1340870 A1 | 9/2003 |

(Continued)

OTHER PUBLICATIONS

Extended Search Report issued Dec. 27, 2011, in counterpart International Application No. 10164291.6-1267 (6 pages, in English).

*Primary Examiner* — Thomas Beach
*Assistant Examiner* — Faria Ahmad
(74) *Attorney, Agent, or Firm* — NSIP Law

(57) ABSTRACT

Provided is a door lock apparatus which is adopted in an electronic product to lock or release a door of the door lock apparatus. The door lock apparatus includes a rocker, a rocker supporting member, a door lock main body and a locking unit. The rocker rotates when the hook of the door enters or withdraws from the door lock apparatus, to be coupled with or separated away from the hook. A rocker hinge rod and a position fixing rode positioned in parallel to the rocker hinge rod are integrated into the rocker. The rocker supporting member is hinge-coupled with the rocker hinge rod to rotatably support the rocker, reciprocatingly moves in a direction in which the hook enters or withdraws when the rocker is rotated, and receives an elastic force from a first elastic member in the direction in which the hook enters. The door lock main body supports the reciprocating movement of the rocker supporting member, and includes position fixing holes to guide movement of the rocker while being coupled with the position fixing rod when the rocker rotates and to fix the rocker while the rocker is coupled with or separated from the hook. The locking unit locks the rocker while the rocker is coupled with the hook. Accordingly, the door lock apparatus has a simple, compact structure, which has fewer failures, ensures convenience in maintenance and repair and reduces the number of assembly steps.

4 Claims, 8 Drawing Sheets

U.S. PATENT DOCUMENTS

| | | | | |
|---|---|---|---|---|
| 4,960,297 | A * | 10/1990 | Bouse et al. | 292/223 |
| 5,107,082 | A * | 4/1992 | Valenzona | 200/292 |
| 5,570,915 | A * | 11/1996 | Asadurian | 292/242 |
| 5,879,036 | A * | 3/1999 | Moline et al. | 292/210 |
| 6,603,377 | B2 * | 8/2003 | Cho et al. | 335/186 |
| 6,685,241 | B2 * | 2/2004 | Bollmann | 292/341.16 |
| 6,886,868 | B2 * | 5/2005 | Hengelein et al. | 292/201 |
| 7,032,936 | B2 * | 4/2006 | Promutico | 292/95 |
| 2004/0104580 | A1 | 6/2004 | Spiessl et al. | |
| 2005/0194795 | A1 | 9/2005 | Hapke et al. | |

FOREIGN PATENT DOCUMENTS

| | | | |
|---|---|---|---|
| EP | 1469147 | A2 | 10/2004 |
| KR | 10-2005-0066293 | | 6/2005 |
| KR | 10-2007-0036468 | | 4/2007 |
| KR | 10-2008-0030218 | | 4/2008 |
| KR | 10-2009-0126449 | | 12/2009 |
| WO | WO 2007/140755 | A1 | 12/2007 |
| WO | WO 2008/123666 | A1 | 10/2008 |

* cited by examiner

DOOR LOCK APPARATUS

CROSS-REFERENCE TO RELATED APPLICATION

This application claims the benefit under 35 U.S.C. §119 (a) of a Korean Patent Application No. 10-2010-0017205, filed on Feb. 25, 2010, the entire disclosure of which is incorporated herein by reference for all purposes.

BACKGROUND

1. Field

The following description relates to a door lock apparatus, and more particularly, to a door lock apparatus used to lock or release a door of an electronic product.

2. Description of the Related Art

A drum washing machine which is a kind of electronic product includes a large aperture in a front side through which to put laundry and a door mounted therein to open or close the aperture. Upon operation, a drum of the drum washing machine washes the laundry with a head force and a friction force while rotating centered on a horizontal axis. Such a drum washing machine includes a door lock apparatus to automatically lock the door in order to prevent the door from opening during washing. If the door opens during washing, the laundry and detergent water solutions may be discharged out of the machine, so that the washing operation is stopped and in the worse case an accident involving personal injury may occur by the rotating drum.

The door lock apparatus needs to be configured with a relatively simple structure to ensure high reliability and safety so that the long-term use of the door does not cause incorrect operations such as the case where a little impact makes the door easily open. In addition, in the case of an emergency, such as the situation where the door is required to be opened quickly during washing or the case where the door is locked due to an electricity failure, the door lock apparatus has to be able to be manually released by using a certain release member.

When an emergency occurs during washing, if a user tries to forcibly open the door without releasing the locked state using the release member, the case occurs where only a hook of the door is detached from a rocker of the door lock apparatus while the rocker maintains in its current position. Since the detached hook cannot be again inserted into the rocker, the door lock apparatus has to be replaced with a new one in order to close the door. Accordingly, a new door lock apparatus capable of solving the problem is needed.

SUMMARY

The following description relates to a door lock apparatus having a simple, compact structure, which has few failures, ensures convenience in maintenance and repair and reduces the number of assembly steps.

In one general aspect, there is provided A door lock apparatus which is adopted in an electronic product to lock or release a door of the electronic product, including: a rocker to be coupled with or separated from a hook of the door by rotating when the hook enters the door lock apparatus or withdraws from the door lock apparatus, wherein a rocker hinge rod and a position fixing rod positioned in parallel to the rocker hinge rod are integrated into the rocker; a rocker supporting member to be hinge-coupled with the rocker hinge rod to rotatably support the rocker, to reciprocatingly move in a direction in which the hook enters or withdraws when the rocker is rotated, and to receive an elastic force from a first elastic member in the direction in which the hook enters; a door lock main body to support the reciprocating movement of the rocker supporting member, the door lock main body including position fixing holes to guide movement of the rocker while being coupled with the position fixing rod when the rocker rotates and to fix the rocker while the rocker is coupled with or separated from the hook; and a locking unit to lock the rocker while the rocker is coupled with the hook.

Therefore, since the position fixing rod is integrated into the rocker, the rocker can have a simple, compact structure. Accordingly, the door lock apparatus may have few failures, ensure convenience in maintenance and repair and reduce the number of assembly steps. Further, since the coupled or separated state of the rocker and hook can be stably maintained due to the inter-action between the position fixing rod and the position fixing hole, incorrect operation can be prevented through a relatively simple structure, which leads to high reliability and safety.

When a user tries to forcibly open the door while the rocker is locked so as to detach only the hook from the rocker though maintaining the rocker in its current position, the user can manually move the rocker to a position at which the rocker can be again coupled with the hook. Accordingly, the door lock apparatus has fewer failures, resulting in a reduction of economic loss due to replacement.

Also, in the case of emergency, such as a situation where the door is required to be opened quickly during washing or the case where the door is locked due to an electricity failure, the door lock apparatus can be manually converted into a release state by a release member.

Other features and aspects will be apparent from the following detailed description, the drawings, and the claims.

Figure 1:
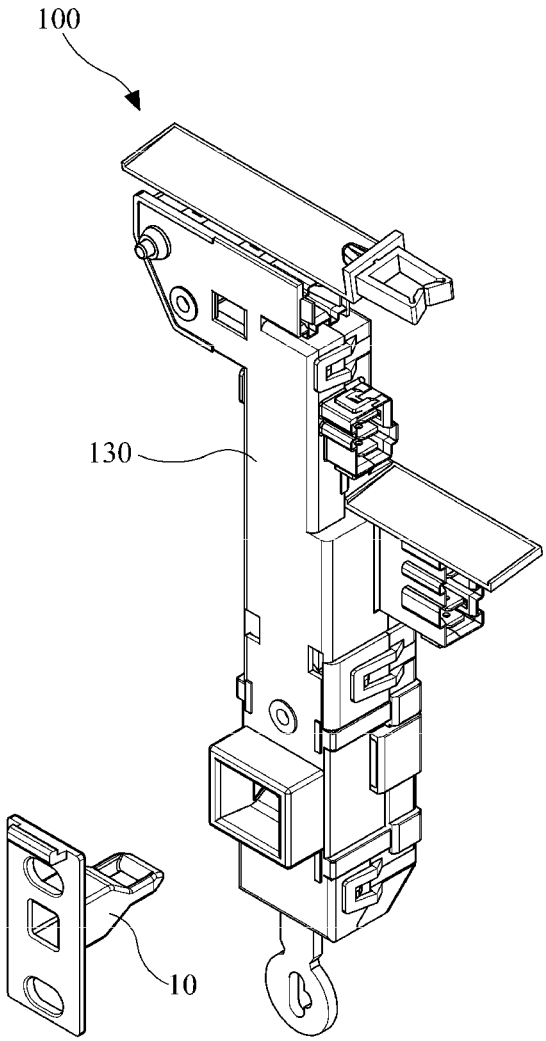
FIG. 1 is a perspective view illustrating an example of a door lock apparatus.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

The following description is provided to assist the reader in gaining a comprehensive understanding of the methods, apparatuses, and/or systems described herein. Accordingly, various changes, modifications, and equivalents of the methods, apparatuses, and/or systems described herein will be suggested to those of ordinary skill in the art. Also, descriptions of well-known functions and constructions may be omitted for increased clarity and conciseness.

Figure 2:
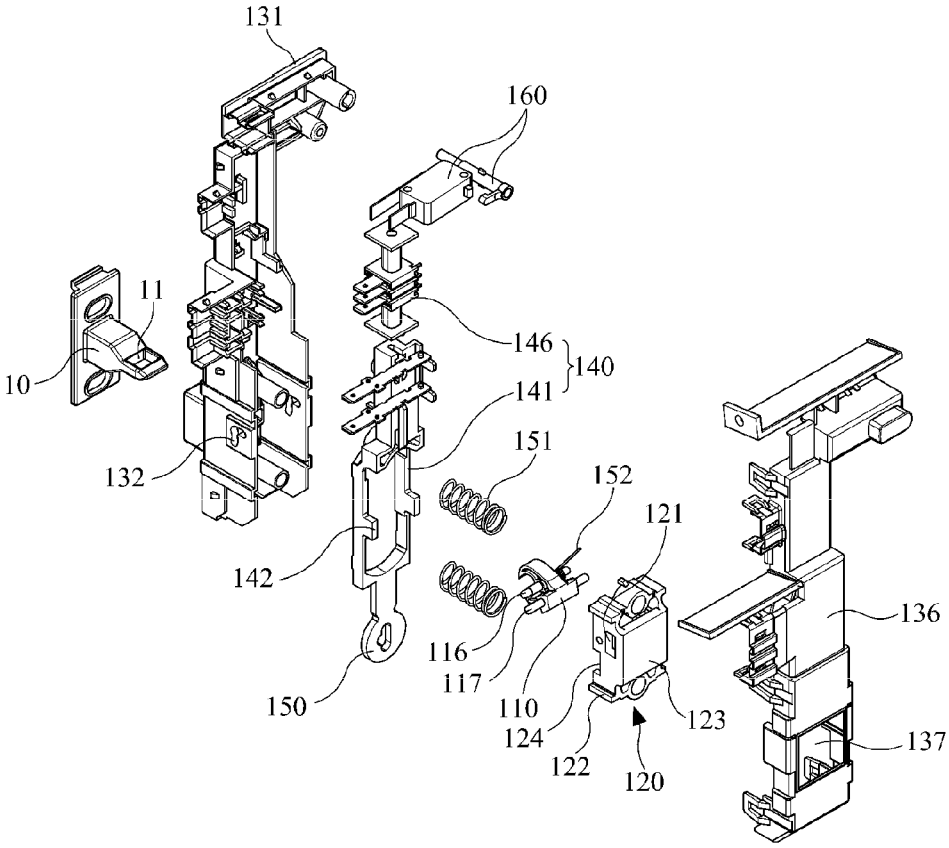
FIG. 2 is an exploded, perspective view of the door lock apparatus illustrated in FIG. 1.

FIG. 1 is a perspective view illustrating an example of a door lock apparatus 100, and FIG. 2 is an exploded, perspective view of the door lock apparatus 100 illustrated in FIG. 1.

Figure 3:
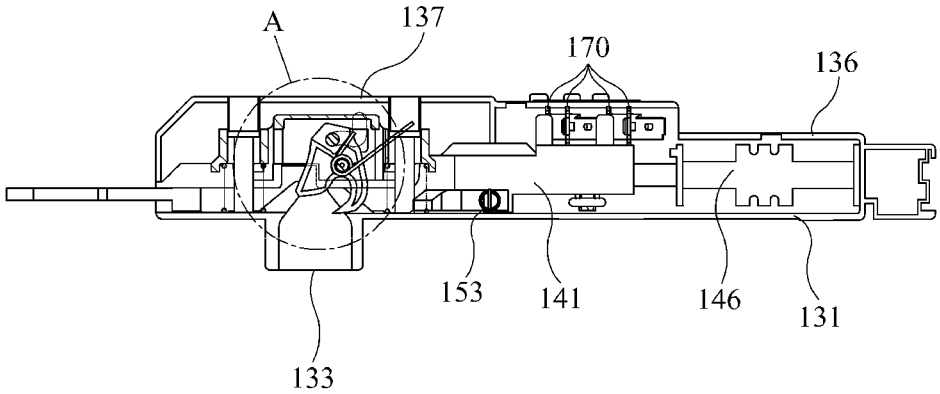
FIG. 3 is a side sectional view of the door lock apparatus illustrated in FIG. 1.
Figure 4:
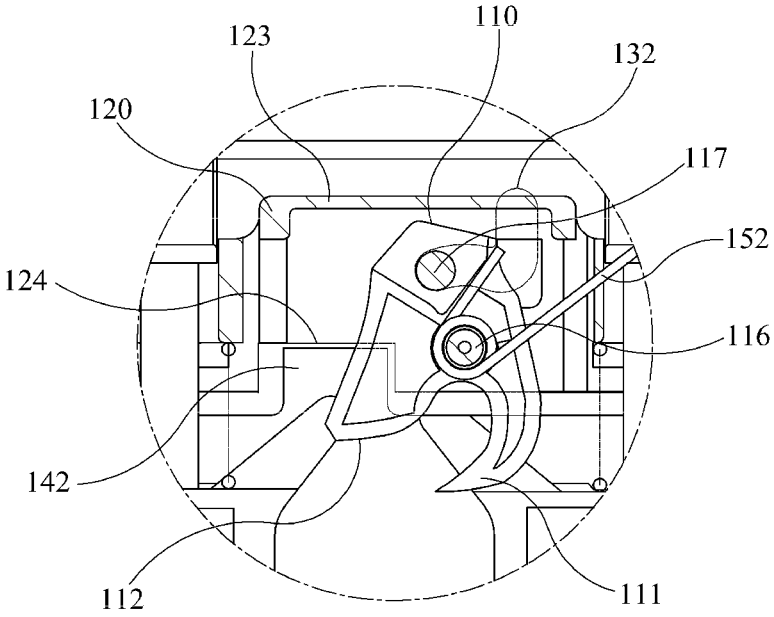
FIG. 4 is an enlarged view of a part A of FIG. 3.

FIG. 3 is a side sectional view of the door lock apparatus 100 illustrated in FIG. 1 and FIG. 4 is an enlarged view of a part A of FIG. 3.

Referring to FIGS. 1 through 4, the door lock apparatus 100 is adopted in various electronic products including a drum washing machine to lock or release a door, and the door lock apparatus 100 includes a rocker 110, a rocker supporting member 120, a door lock main body 130 and a locking unit 140.

The rocker 110 has a structure which is coupled with or separated away from a hook 10 while rotating when the hook 10 enters or withdraws from the door lock apparatus 100. For example, a fixing hook 111 and a press portion 112 are formed around the rocker 110, and the hook 10 has a coupling hole 11 to be inserted with the fixing hook 111.

When the hook 10 enters the door lock apparatus 100, the press portion 112 is moved back by an apex of the hook 10, thus rotating the rocker 110. Then, the fixing hook 111, which is curved in a hook shape, is inserted into the couple hole 11 of the hook 10 to couple the hook 10.

The rocker 110 includes a rocker hinge rod 116 and a position fixing rod 117 positioned in parallel to the rocker hinge rod 116. The rocker hinge rod 116 is hinge-coupled to the rocker supporting member 120 to rotatably support the rocker 110. The position fixing rod 117 interacts with position fixing holes 132 (to be described later) to fix the rocker 110 at a position coupled with or separated away from the hook 10.

If the position fixing rod 117 is integrated with the rocker 110, the structure of the rocker 110 may be simplified and smaller in size compared to the structure where the position fixing rod 117 is separated from the rocker 110. In other words, if the position fixing rod 117 is separated from the rocker 110, a plurality of locking grooves have to be formed around the rocker 110 for the position fixing rod 117 to be caught and fixed at a position where the rocker 110 is coupled with and separated from the hook 10, respectively.

However, if the position fixing rod 117 is integrated with the rocker 110, no locking grooves are needed, which makes the structure of the rocker 110 simple and compact. Accordingly, the door lock apparatus 100 may have fewer failures, ensure convenience in maintenance and repair and reduce the number of assembly steps.

Both side walls of the locker supporting member 120 are hinge-coupled with both ends of the rocker hinge rod 116 to rotatably support the rocker 110. In addition, the rocker supporting member 120 may include long holes 121 at its side walls, through which the location fixing rod 117 passes to move freely while the rocker 110 rotates.

When the rocker 110 rotates, the rocker supporting member 120 travels back and forth in the direction in which the hook 10 enters or withdraws from the door lock apparatus 100, due to interaction of the position fixing rod 117 and the position fixing holes 132. In other words, when the hook 10 enters the door lock apparatus 100, the rocker supporting member 120 moves back along the direction in which the hook 10 enters while the rocker 110 is pushed back by the hook 10 and rotates. Meanwhile, when the hook 10 withdraws from the door lock apparatus 100, the rocker supporting member 120 moves forth along the direction in which the hook 10 withdraws while the rocker 110 is pulled by the hook 10 and rotates.

The reciprocating motion of the rocker supporting member 120 may be supported by the door lock main body 130. For this, rails 122 are formed at side walls of the rocker supporting member 120 and guide grooves into which the rails 122 are put are formed in the door lock main body 130.

The rocker supporting member 120 receives an elastic force from first elastic members 151 in the direction in which the hook 10 enters. This is aimed at the position fixing rod 117 maintaining a position-fixed state at both ends of the position fixing holes 132. The first elastic members 151 may be two compression springs. The compression springs 151 are installed in the rocker supporting member 120 to face the hook 10 in a compressed state in such a manner that that both ends of the compression springs 120 are respectively fixed to the locker supporting member 120 and the door lock main body 130.

The door lock main body 130 supports the reciprocating motion of the rocker supporting member 120. The door lock main body 130 has the position fixing holes 132 in both side walls thereof. The position fixing holes 132 accommodate, when the rocker rotates, both sides of the position fixing rod 117 to guide movement of the position fixing rod 117 while fixing the position of the rocker 110 when the rocker 110 is coupled with and separated away from the hook 10. The position fixing holes 132 are formed in correspondence to the travel trace of the position fixing rod 117. For example, the position fixing holes 132 may be openings each having a "¬"-shape connecting a horizontally extending hole to a vertically extending hole.

In this way, the rocker 110 may be stably coupled with or separated from the hook 10 by interactions of the position fixing holes 132 and the position fixing rod 117. Accordingly, the door lock apparatus 100 has a relatively simple structure to prevent incorrect operation and can ensure high reliability and safety.

The door lock main body 130 is composed of first and second casings 131 and 136, and the first and second casings 131 and 136 have a structure capable of containing the rocker 110, the rocker supporting member 120 and the locking unit 140 therein. The first casing 131 has an inlet 133 which faces the rocker 110 and connects to the inner space of the door lock apparatus 100, and the hook 10 passes through the inlet 133 to be coupled with or separated from the rocker 110.

The locking unit 140 is used to lock the rocker 110 while the rocker 110 is coupled with the hook 10. If rotation of the rocker 110 is not restricted when the rocker 110 is coupled with the hook 10, the rocker 110 will be separated away from the hook 10 when the hook 10 is pulled front. That is, the door may be freely opened. However, if the rocker 110 is locked by the locking unit 140, the rocker 110 is maintained to be coupled with the hook 10 when the hook 10 is pulled front, so that the door is not opened. Accordingly, the door of an electronic product, for example, a drum washing machine can be prevented from being opened while the electronic product is operating, thereby ensuring safe use of the electronic product.

Meanwhile, when a user tries to forcibly open the door while the rocker 110 is locked, the case occurs where only the hook 10 of the door is detached from the rocker 110 while the rocker 110 maintain in its original position. In this case, the hook 10 cannot be again coupled with the rocker 110 although the user tries to close the door. In order to solve the problem, the rocker supporting member 120 includes a button unit 123 and the rocker 110 may include a second elastic member 152.

The button unit 123 is formed in the rocker supporting member 120 and faces in a direction which is opposite to the facing side of the hook 10. Also, the button unit 123 is exposed through an opening 137 of the door lock main body 130 in order for a user to press the button unit 123. The opening 137 may be formed in the second casing 136 in correspondence to the button unit 123.

The second elastic member 152 applies an elastic force in a direction in which the locker 110 is separated from the hook 10, thus causing, when the button unit 123 is pressed while the rocker 110 is unlocked and coupled with the hook 10, the rocker 110 to move to a position automatically at which the rocker 110 is separated from the hook 10. That is, the second elastic member 152 is elastically deformed when the rocker 110 rotates in a direction in which the rocker 110 is coupled with the hook 10, and then moves to a position at which the rocker 110 is separated from the hook 10 by an elastic restoring force when the button unit 123 is pressed for the position fixing rod 117 to reach the curved points of the position fixing holes 132. The second elastic member 152 may be torsion springs and inserted into the rocker hinge rod 116.

Meanwhile, the locking unit 140 may include a slider 141 and a solenoid driving unit 146. The slider 141 is positioned to face the hook 10 and operates to limit the movement of the rocker supporting member 120, thus locking or releasing the coupled state of the rocker 110 and the hook 10. For this operation, the slider 141 includes locking protrusions 142 and the rocker supporting member 120 includes accommodation grooves 124. The locking protrusions 142 are formed in parts of the slider 141 to face the rocker supporting member 120.

When the locking protrusions 142 move to a position at which the locking protrusions 142 can be accommodated into the accommodation grooves 124, the locking protrusions 142 do not restrict rotation of the rocker 110 since the rocker supporting member 120 travels forward and backward without being interrupted. When the rocker 110 is coupled with the hook 10 and thus the rocker supporting member 120 is pulled, if the locking protrusions 142 are released from the accommodation grooves 124 to block movement of the rocker supporting member 120, the rotation of the rocker 110 is restricted. Accordingly, the rocker 110 is coupled with the hook 10 and locked.

The solenoid driving unit 146 is used to operate the slider 141 according to a lock signal or a release signal. That is, the solenoid driving unit 146 moves, when receiving a lock signal, the slider 141 to a position at which the locking protrusions 142 are released from the accommodation grooves 124, and moves, when receiving a release signal, the slider 141 to a position at which the locking protrusions 142 are accommodated in the accommodation grooves 124.

The solenoid driving unit 146 includes a flange which reciprocatingly travels in a direction which crosses the travel direction of the rocker supporting member 120. The flange is put into and coupled with a flange groove of the slider 141 to reciprocatingly move the slider 141. The solenoid driving unit 146 may be supported by an elastic element 153 and fixed after pushing or pulling the slider 141.

Meanwhile, the door lock apparatus 100 may include a plurality of contact terminals 170 to detect whether the rocker 110 is locked or released to decide whether or not to operate the corresponding electronic product. The contact terminals 170 may be a pair of contact terminals. When the contact terminals 170 are a pair of contact terminals, one of the contact terminal pair is fixed to the slider 141 and the other one is fixed to the door lock main body 130. The contact terminals 170 are connected to or disconnected from each other when the slider 141 moves to lock or release the rocker 110, thereby applying power on/off information to a controller, etc. of the electronic product.

In addition, the door lock apparatus 100 may include a release member 150 to manually release the locked state of the rocker 110 in case of emergency, such as a situation where the door is required to be opened quickly while the electronic product is operating or the case where an electricity failure occurs after the rocker 110 is locked.

The release member 150 is connected to one of both ends of the slider 141, for example, to an end of the slider 141 not connected to the solenoid driving unit 146. If a user pulls the release member 150, the slider 141 is pulled together with the release member 150 and accordingly passes the accommodation groove 124 therethrough while the locking protrusions 142 of the slider 141 block movement of the rocker supporting member 120, thereby releasing the locked state of the rocker 110.

Meanwhile, the door lock apparatus 100 may include a door open/close sensing switch 160 to sense whether the door is opened or closed. The door open/close sensing switch 160 senses whether the door is opened or closed by sensing whether the door open/close sensing switch 160 is pressed by the door or released from the state pressed by the door when the door is opened or closed. Information sensed by the door open/close sensing switch 160 may be displayed on a display of the electronic product.

An example of operation of the door lock apparatus 100 described above will be described with reference to FIGS. 5 through 8, below.

Figure 5:
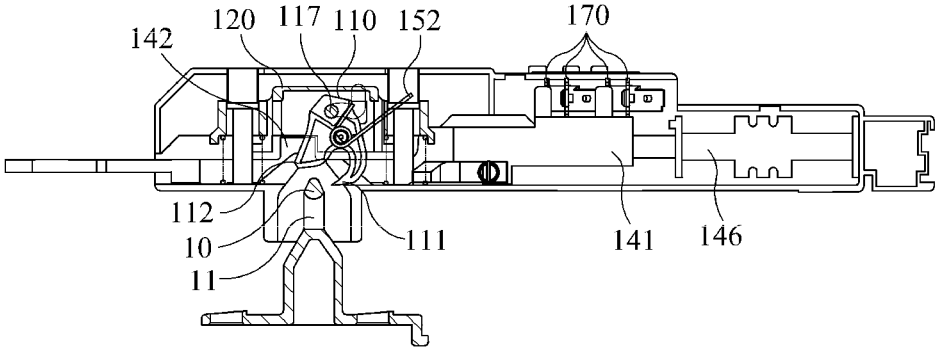
FIGS. 5 through 8 are side sectional views for explaining an example of operation of the door lock apparatus illustrated in FIG. 3.

First, as illustrated in FIG. 5, before the hook 10 passed through the inlet 133 of the door lock main body 130 contacts the rocker 110, the rocker 110 stays after rotating to a position at which the fixing hook 111 is coupled with the coupling hole 11 of the hook 10. At this time, the rocker 110 can be maintained in a standby state since the position fixing rod 117 of the rocker 110 is fixed at the left ends of the position fixing holes 132 by an elastic force applied from the first elastic member 151 to the rocker supporting member 120.

Figure 6:
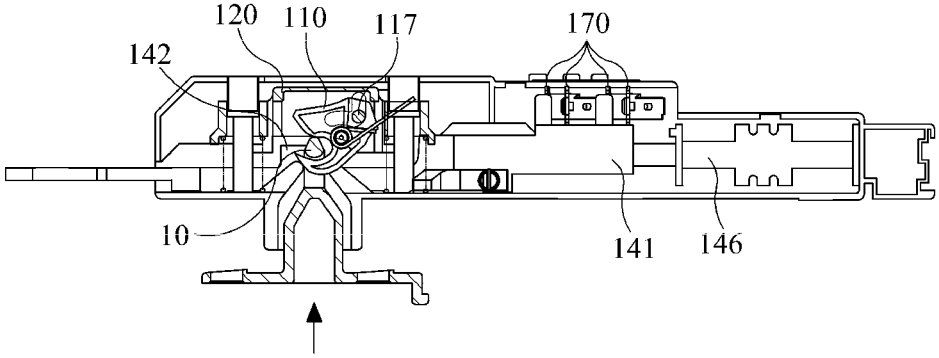

Thereafter, as illustrated in FIG. 6, if the hook 10 continues to be inserted while contacting the press portion 112 of the rocker 110, the rocker 110 rotates so that the fixing hook 111 is coupled with the coupling hole 11 of the hook 10. At this time, the position fixing rod 117 moves along the position fixing holes 132 to allow the rocker supporting member 120 to rise and simultaneously the rocker 110 to continue to rotate. Then, the position fixing rod 117 moves up to the curved points of the position fixing holes 132.

Figure 7:
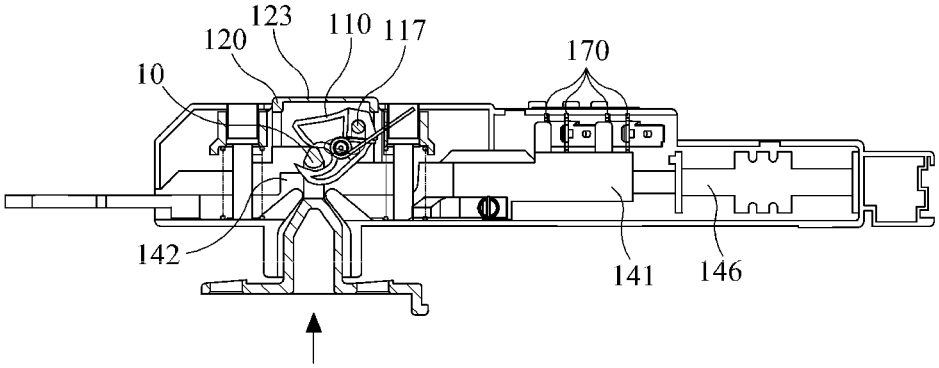

If the hook 10 continues to be inserted and presses the press portion 112, as illustrated in FIG. 7, the position fixing rod 117 changes the traveling direction to reach the upper ends of the position fixing holes 132. At this time, the position fixing rod 117 is position-fixed to the upper ends of the position fixing holes 132 by an elastic restoring force applied to the rocker supporting member 120, thereby being maintained to be coupled with the hook 10.

Figure 8:
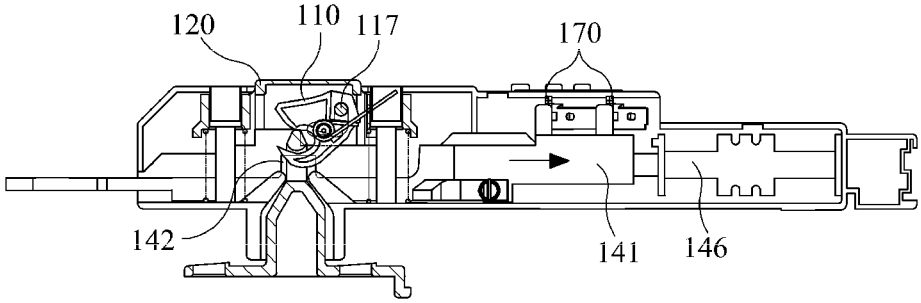

At this time, if a lock signal is input to the solenoid driving unit 146 to lock the rocker 110, as illustrated in FIG. 8, the solenoid driving unit 146 moves the slider 141 to a position at which the locking protrusions 142 move out of the accommodation grooves 124, thus preventing the rocker supporting member 120 from moving down. Accordingly, the rocker 110 is caught and locked while being coupled with the hook 10. At this time, the contact terminals 170 separated away from each other contact each other when the slider 141 moves to lock the rocker 110 so as to provide power on/off information to a controller, etc. of the electronic product.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. A door lock apparatus which is adopted in an electronic product to lock or release a door of the electronic product, comprising:

a rocker to be coupled with or separated from a hook of the door by rotating when the hook enters the door lock apparatus or withdraws from the door lock apparatus, wherein a rocker hinge rod and a position fixing rod positioned in parallel to the rocker hinge rod are integrated into the rocker;

a rocker supporting member to be hinge-coupled with the rocker hinge rod to rotatably support the rocker, to reciprocatingly move in a direction in which the hook enters or withdraws when the rocker is rotated, and to receive an elastic force from a first elastic member in the direction in which the hook enters;

a door lock main body to support the reciprocating movement of the rocker supporting member, the door lock main body including position fixing holes to guide movement of the rocker while being coupled with the position fixing rod when the rocker rotates and to fix the rocker while the rocker is coupled with or separated from the hook;

a locking unit to lock the rocker while the rocker is coupled with the hook;

a button unit formed in the rocker supporting member and facing in a direction which is opposite to a facing direction of the hook, the button unit exposed through an opening of the door lock main body; and a second elastic member to apply an elastic force in a direction in which the rocker is separated from the hook, thus causing, when the button unit is pressed while the rocker is unlocked and coupled with the hook, the rocker to move automatically to a position at which the rocker is separated from the hook.

2. The door lock apparatus of claim 1, wherein the locking unit comprises:

a slider positioned to face the hook and restricting movement of the rocker supporting member, thus locking or releasing a coupled state of the rocker and the hook; and a solenoid driving unit to operate the slider according to a locking signal or a release signal.

3. The door lock apparatus of claim 2, further comprising a release member to manually move the slider to release a locked state of the rocker.

4. The door lock apparatus of claim 1, further comprising a door open/close sensing switch to sense whether the door is opened or closed.

* * * * *